United States Patent [19]

Tasaki et al.

[11] Patent Number: 4,681,188

[45] Date of Patent: Jul. 21, 1987

[54] INTAKE SILENCER

[75] Inventors: Takanobu Tasaki, Tokyo; Akira Nagashima, Kawasaki, both of Japan

[73] Assignee: Kioritz Corporation, Tokyo, Japan

[21] Appl. No.: 869,455

[22] Filed: May 28, 1986

[30] Foreign Application Priority Data

Jun. 5, 1985 [JP] Japan ..... 60-83969[U]

[51] Int. Cl.[4] ..... F02M 35/00

[52] U.S. Cl. ..... 181/229; 181/258

[58] Field of Search ..... 181/229, 256, 258

[56] References Cited

U.S. PATENT DOCUMENTS

| | | | |
|---|---|---|---|
| 3,614,859 | 10/1971 | Clark | 181/229 X |
| 4,065,276 | 12/1977 | Nakaya et al. | 181/229 X |
| 4,236,901 | 12/1980 | Kato et al. | 181/229 X |
| 4,450,933 | 5/1984 | Fukuoka et al. | 181/229 |

*Primary Examiner*—Benjamin R. Fuller

*Attorney, Agent, or Firm*—Browdy and Neimark

[57] ABSTRACT

An intake silencer comprising a cup-shaped body made of elastic material to cover an air inlet of carburetor chamber of an internal combustion engine. A plurality of intake passages are provided to pass through side walls of the body. A circumferential groove is formed along an edge of an opening portion of the body. An air filter element is received along its edge by the circumferential groove.

3 Claims, 4 Drawing Figures

INTAKE SILENCER

BACKGROUND OF THE INVENTION (1) Field of the Invention

The present invention relates to an improvement in an intake silencer adapted to be attached directly to an air inlet of a carburetor chamber of a portable power driven machine having an internal combustion engine as a power source, such as a chain saw.

(2) Description of the Prior Art

Such an intake silencer is well known in the art. In the well known intake silencer disclosed in, for example, Japanese Utility Model Unexamined Publication No. 81767/1984, a plurality of intake pipes are provided to pass through side walls of an inverted cup-shaped carburetor chamber cover, and a plate-like air filter element is attached to an opening portion of the carbureter chamber with its peripheral edge portions being interposed between the cover and the chamber body through a packing.

When such an intake silencer is attached to the carburetor chamber, if the mounting position of the packing is displaced even slightly, then an external air is introduced directly to the carburetor through the air filter or along the edges of the packing. Then, even though the intake silencer is attached, an undesirable intake noise will be made or an air entraining dusts will be introduced unintentionally into the carburetor. Thus, careful attentions should be paid to the attachment work of the intake silencer. In some cases, a satisfactory muffling effect cannot be obtained.

SUMMARY OF THE INVENTION (1) Object of the Invention

In order to overcome the above-noted prior art defects, an object of the present invention is to provide an intake silencer which is capable of facilitating its mounting work and reducing an intake noise.

(2) Statement of the Invention

According to the present invention, an intake silencer having a plurality of intake passages is integrally formed of an elastic material, and is provided with a circumferential groove extending along an edge of its opening portion. The groove is adapted to receive edges of an air filter element. Accordingly, it is sufficient to mount the air filter element onto the intake silencer and to mount the silencer onto an air inlet of a carburetor chamber. Since the intake silencer per se is made of elastic material, a packing may be dispensed with. In addition to the effect of considerably facilitating the mounting work of the intake silencer, the silencer per se is elastically deformed upon the suction of air, thereby suppressing the generation of intake noises.

DESCRIPTION OF THE PREFERRED EMBODIMENT

The present invention will now be described with reference to the accompanying drawings.

Figure 1:
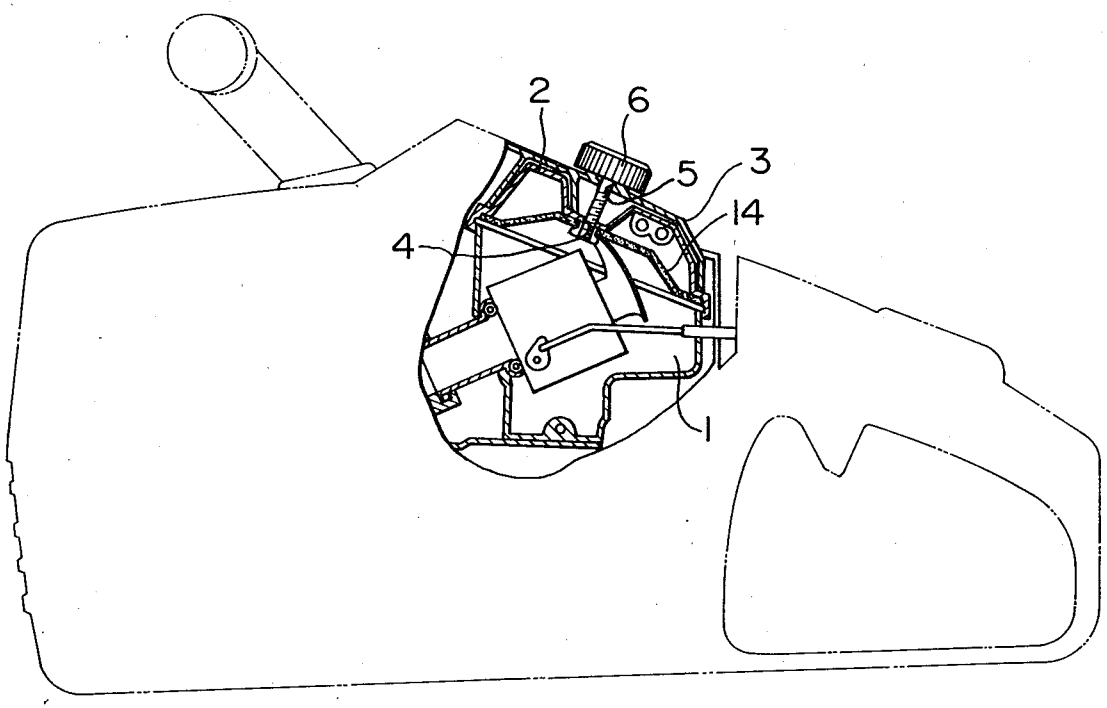
FIG. 1 is a partially fragmentary schematic cross-sectional view showing a state in which an intake silencer is attached to a carburetor chamber in accordance with the invention.
Figure 2:
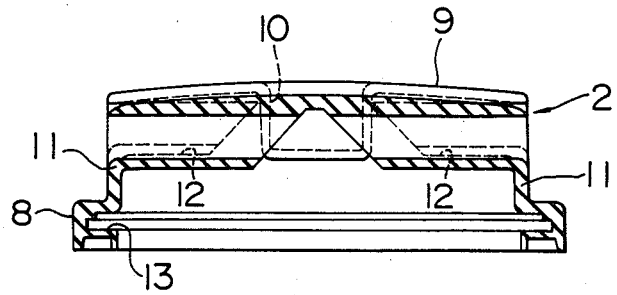
FIG. 2 is a cross-sectional view of the intake silencer taken along the line II—II of FIG. 4.
Figure 3:
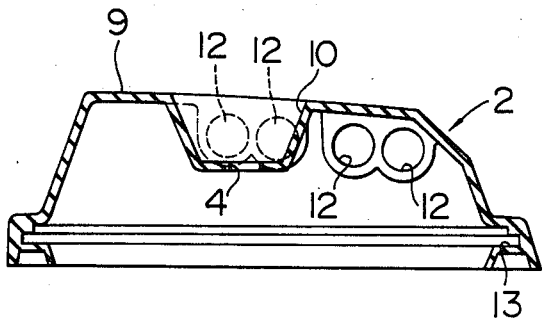
FIG. 3 is a cross-sectional view taken along the line III—III of FIG. 4.
Figure 4:
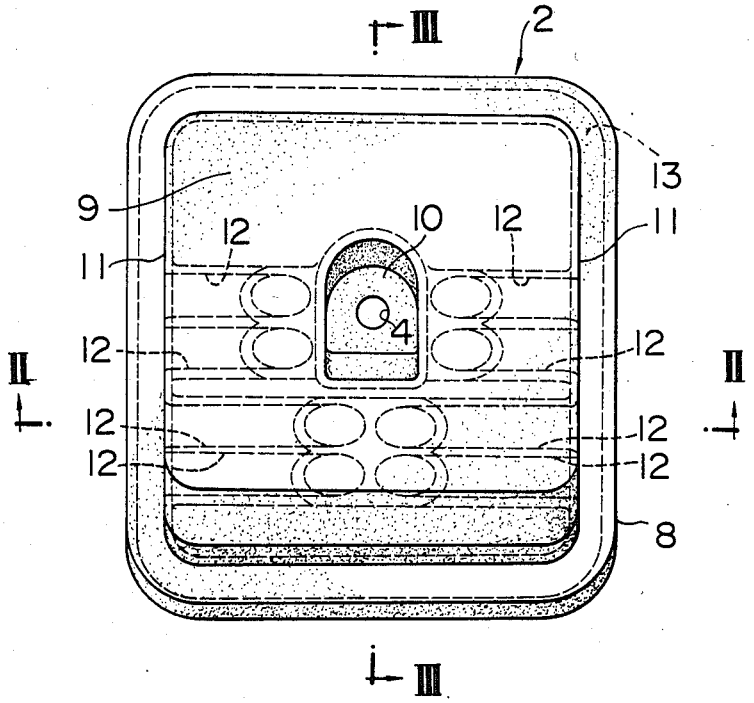
FIG. 4 is a plan view of the intake silencer body shown in FIGS. 1 through 3.

In FIG. 1, there is shown a carbureter chamber generally designated by reference numeral 1. To a top opening portion of the carburetor chamber 1, there is attached an intake silencer 2 which is integrally formed of elastic material such as rubber, in accordance with the present invention. A carburetor chamber cover 3 is attached to cover the intake silencer 2. The intake silencer 2 and the cover 3 are fastened together to the carburetor chamber 1 by means of a fastening bolt 6 passing through mounting bores 4 and 5 formed in the central portions of the intake silencer 2 and the cover 3.

The intake silencer 2 is composed of an inverted cup-shaped body 8. The above-described central bore 4 is formed at a bottom of a recess portion 10 provided in a central portion of a top wall 9 of the body 8. A plurality of cylindrical intake passages 12 passing through side walls 11 of the body 8 are opened around the central recess portion 10. Since an external air is introduced through these intake passages 12 into the carburetor chamber 1, an intake noise is prevented from leaking to the outside.

In a bottom opening portion of the body 8 of the intake silencer 2, there is formed a circumferential groove 13 extending along the edge of the body 8. As shown in FIG. 1, the groove 13 is adapted to receive an edge of a plate-like air filter element 14. Then, under such a condition, when the carburetor chamber cover 3 is provided on the intake silencer 2 and the edge of the intake silencer body 8 is aligned with the edge of the top opening portion of the carburetor chamber 1 to fasten the fastening bolt 6, because the intake silencer body 8 per se is made of elastic material, the edge thereof serves as a packing, thereby prevent the external air from directly entering between the intake silencer 2 and the carburetor chamber 1. Therefore, the external air is sucked into the intake passages 12 from a space, communicating with the outside, between the cover 3 and the intake silencer 2, thereby reducing the leakage of the intake noise to the outside and enhancing dust proof property.

What is claimed is:

1. An intake silencer comprising a cup-shaped body made of elastic material, siad cup-shaped body covering an air filter element provided at an air inlet of a carburetor chamber of an internal combustion engine, a plurality of intake passages passing through side walls of said body, and means defining a circumferential groove provided along an edge of an opening portion of said body facing said air filter element for receiving an edge of said air filter element.

2. The intake silencer according to claim 1, wherein a recess portion is formed in a central portion of a top wall of said body, and said intake passages are arranged around said recess portion.

3. The intake silencer according to claim 2, wherein a through hole for a fastening bolt is formed at a bottom portion of said recess portion, and said air filter element and said body is fastened to the carburetor chamber by said fastening bolt.

* * * * *